US010035689B2

(12) United States Patent
Iotti

(10) Patent No.: US 10,035,689 B2
(45) Date of Patent: Jul. 31, 2018

(54) LOADING PLATFORM

(71) Applicant: MANITOU ITALIA S.R.L., Castelfranco Emilia (MO) (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 64 days.

(21) Appl. No.: 15/265,131

(22) Filed: Sep. 14, 2016

(65) Prior Publication Data

US 2017/0081161 A1 Mar. 23, 2017

(30) Foreign Application Priority Data

Sep. 17, 2015 (IT) ..... 10201552689

(51) Int. Cl.

| | |
|---|---|
| ***B66F 9/12*** | (2006.01) |
| ***E04G 5/14*** | (2006.01) |
| ***E05D 3/00*** | (2006.01) |
| ***B66F 11/04*** | (2006.01) |

(52) U.S. Cl.

CPC ..... *B66F 9/127* (2013.01); *B66F 11/04* (2013.01); *E04G 5/14* (2013.01); *E05D 3/00* (2013.01); *E05Y 2900/60* (2013.01)

(58) Field of Classification Search

CPC ..... B66F 9/127; B66F 11/04

See application file for complete search history.

(56) References Cited

U.S. PATENT DOCUMENTS

| | | | | |
|---|---|---|---|---|
| 5,425,433 | A * | 6/1995 | Huber | B66F 11/04 182/145 |
| 6,503,020 | B1 * | 1/2003 | Mascioletti | E04B 1/2604 403/231 |
| 8,257,008 | B2 * | 9/2012 | Ellingson | B66F 9/127 182/14 |
| 2006/0225955 | A1 | 10/2006 | Murphy | |
| 2009/0096231 | A1 | 4/2009 | Burlingame | |
| 2010/0200332 | A1 | 8/2010 | Bowden | |
| 2011/0070458 | A1 * | 3/2011 | Quan | B32B 3/12 428/593 |
| 2013/0256058 | A1 * | 10/2013 | Borghi | B66F 11/04 182/113 |
| 2013/0272777 | A1 | 10/2013 | Hayter et al. | |

FOREIGN PATENT DOCUMENTS

| | | | | |
|---|---|---|---|---|
| DE | 4324909 | C2 * | 2/1996 | B66F 9/127 |
| EP | 3144267 | A3 * | 7/2017 | B66F 9/127 |
| WO | 95/22502 | A1 | 8/1995 | |
| WO | 2009/037429 | A1 | 3/2009 | |
| WO | 2012/075536 | A1 | 6/2012 | |

* cited by examiner

*Primary Examiner* — Kaitlin S Joerger
(74) *Attorney, Agent, or Firm* — Pearne & Gordon LLP

(57) ABSTRACT

A loading platform (1) for telescopic handlers comprises a bottom plane (2) provided for supporting operators and/or equipment and associated with sidewalls (3, 4).
The plane (2) and the sidewalls (3, 4) include respective first interlocking and/or hinge means (31, 221) such that the sidewalls (3, 4) can be secured removably to the plane (2), thereby defining a mountable and demountable platform (1).

12 Claims, 8 Drawing Sheets

LOADING PLATFORM

The invention has for object a loading platform for telescopic handlers or the like.

The loading platforms of the known type comprise a bottom plane arranged for supporting operators and equipment, around which bottom plane there are disposed walls, i.e. sidewalls, having the function of preventing operators, or the equipment lying on the bottom plane, from accidentally falling onto the ground.

The loading platforms are predisposed for being connected to a telescopic lifting arm via coupling devices.

The telescopic handlers loading platforms are made with high resistant metallic materials such as iron and steel both for the sake of low-cost constructive reasons and for safety reasons, which implies avoiding even the smallest risk of a platform collapsing which may affect the safety of the operators or cause the equipment to fall onto the ground.

For same reasons the different components of the platform, in particular the bottom plane structure and the sidewalls, are secured one to another by rivets and welds, thereby defining a substantially monolithic unit. However, these devices are not devoid of drawbacks.

Indeed, the known platforms for telescopic handlers are very heavy, which limits either the height at which they can be brought and, above all, the "working radius" permitted, i.e. the horizontal extension of the support arm to which the platform itself is attached.

Furthermore, the international shipping costs of the known platforms are particularly high due to the fact that there exists a considerable imbalance between the amount of material needed for producing the platforms if compared to the very bulky dimensions thereof; in fact, for the shipment purpose, the loading platforms are to be regarded as large empty containers.

Thus the technical task underlying the present invention is to propose a loading platform which overcomes the drawbacks of the prior art.

This technical task is attained by the loading platform made according to claim 1.

Further characteristics and advantages of the present invention will become more apparent from the indicative, and therefore non-limiting description of preferred but non-exclusive embodiments of the inventive loading platform, as illustrated in the accompanying drawings wherein.

With reference to the above figures, the numeral 1 indicates a loading platform for telescopic handlers or the like.

The loading platform 1 of the invention is intended to be connected to a telescopic lifting arm.

The loading platform 1 herein disclosed, first of all comprises a bottom plane 2 that is arranged for the support of operators and/or work equipment.

The plane 2 is associated to sidewalls 3, 4 having the purpose of avoiding accidental falls of the operators or equipment.

Figure 1:
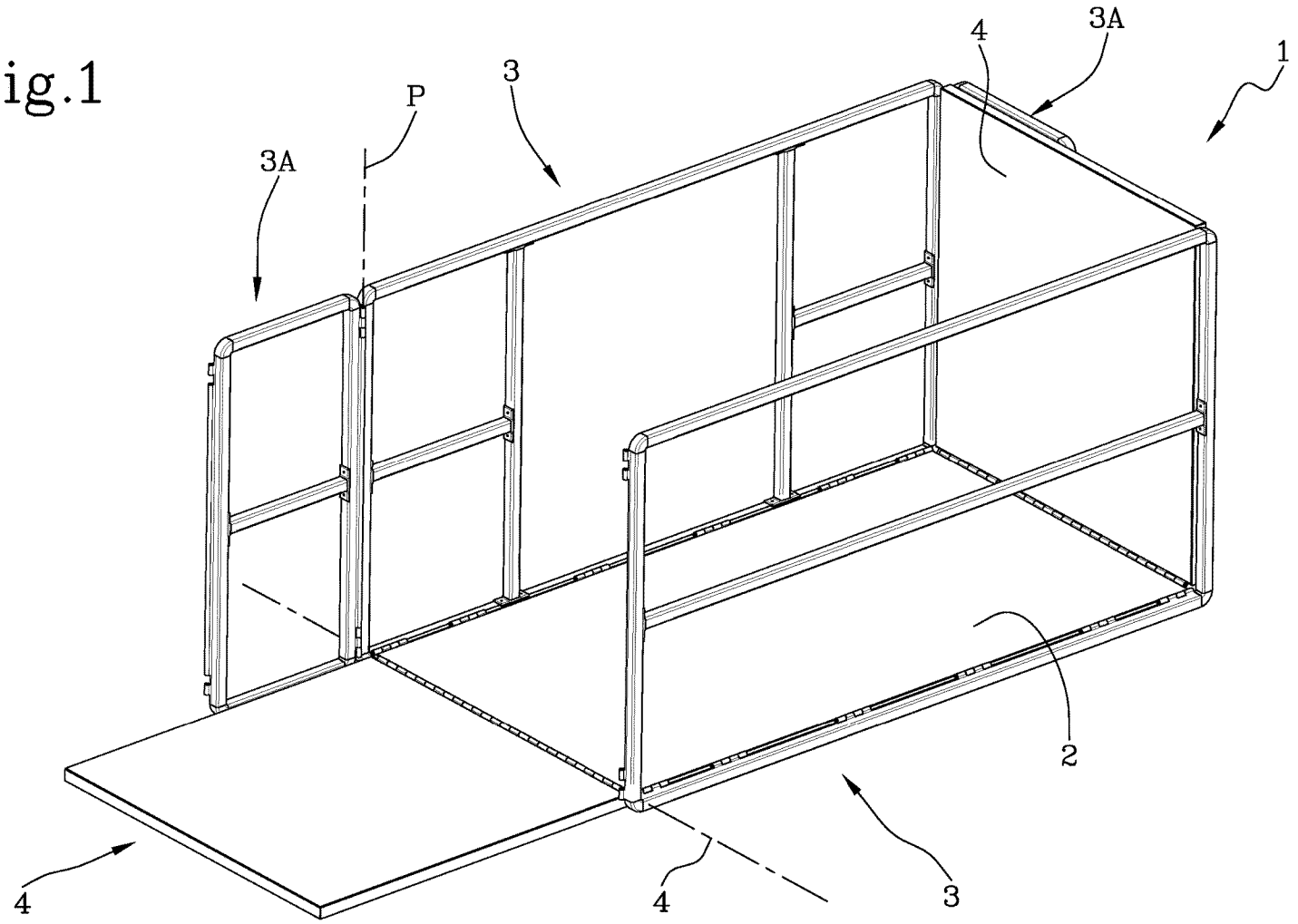
FIG. 1 is an axonometric view of at least a part of the loading platform of the invention.

In particular, the plane 2 is preferably quadrangular-shaped (i.e. rectangular-shaped) and therefore the sidewalls 3, 4 are placed at the perimeter of the plane 2, wherefrom the sidewalls 3, 4 are arising thus defining a sort of cage that is open superiorly (see, for example FIG. 1). In the preferred embodiment of the invention depicted in the figures, the plane 2 is surrounded by truss sidewalls 3 (or with "lattice-work structure") and solid sidewalls 4.

The truss sidewalls 3 are preferably arranged on the long sides, while the solid sidewalls 4, that will form the walking surface when the loading platform 1 is extended, are preferably arranged on the short sides, thereby defining the longitudinal ends of the loading platform 1.

According to an important aspect of the invention, the plane 2 and the sidewalls 3, 4 include respective first interlocking means and/or hinge means 221, 31 in order that the sidewalls may be removably secured to the plane 2, thus defining a mountable and demountable loading platform 1.

In addition, the sidewalls 3, 4 may be provided with respective second interlocking means and/or hinge means 32 in order to removably secure the various sidewalls 3, 4 to one another.

Figure 2:
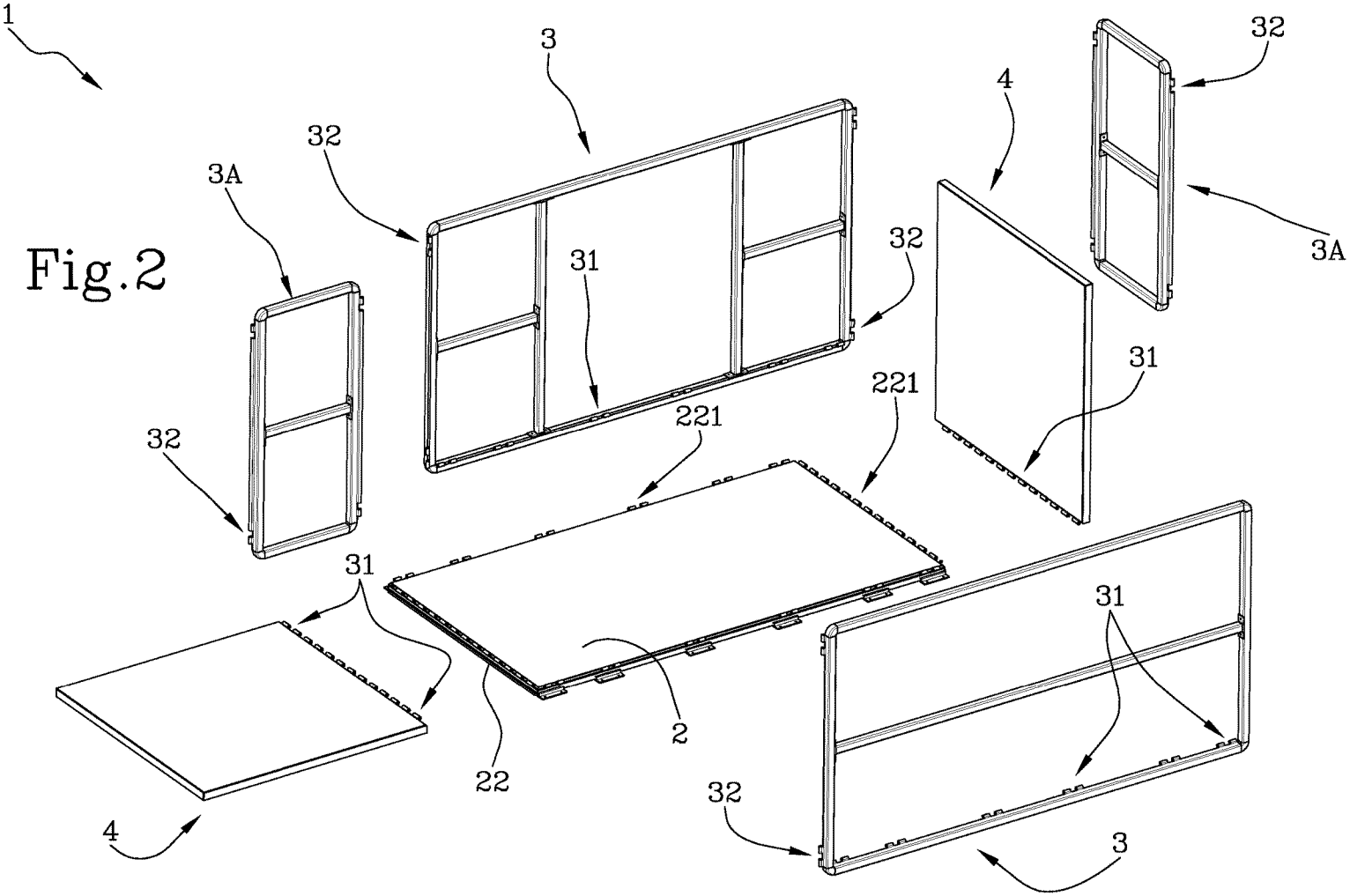
FIG. 2 is an exploded view of the loading platform portion of FIG. 1.
Figure 3:
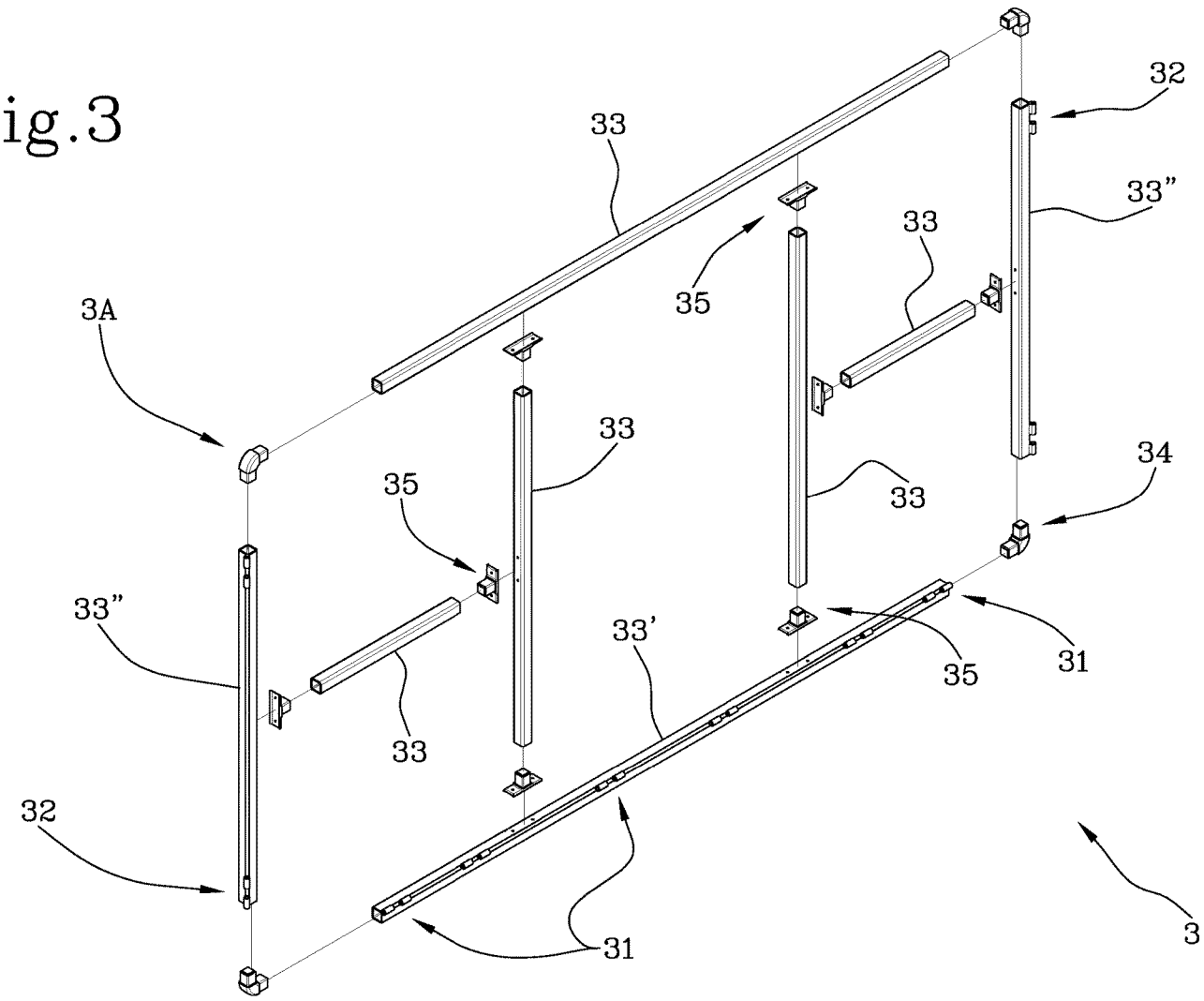
FIG. 3 is an exploded view of a loading platform sidewall.
Figure 4:
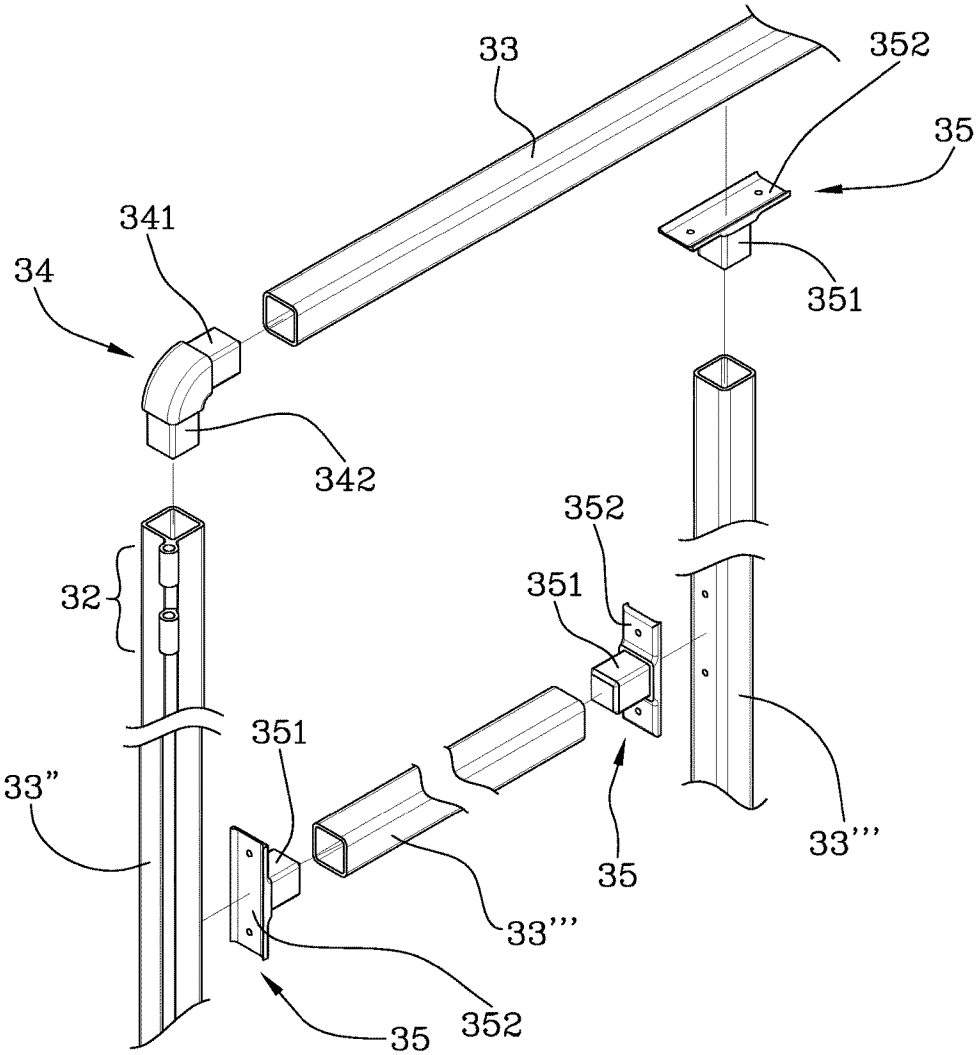
FIG. 4 is an enlarged detail of the previous figure.

In the preferential embodiment of the invention, depicted in the attached figures, the first and second means 31, 32, 221 are hinge means (see in particular FIGS. 2, 3 and 4).

Figure 5:
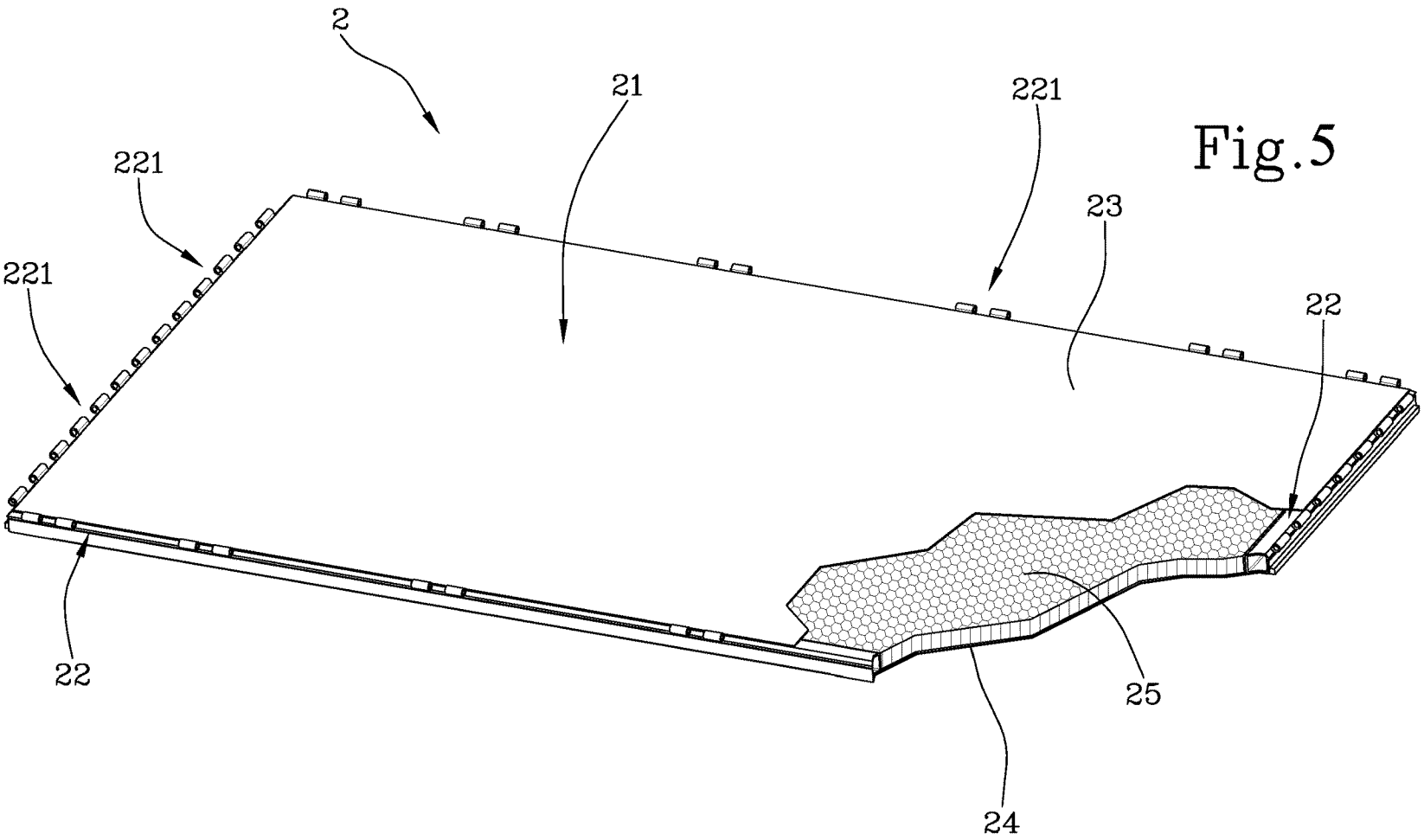
FIG. 5 is an isometric cutaway view of a possible embodiment of the bottom plane of the loading platform.
Figure 6:
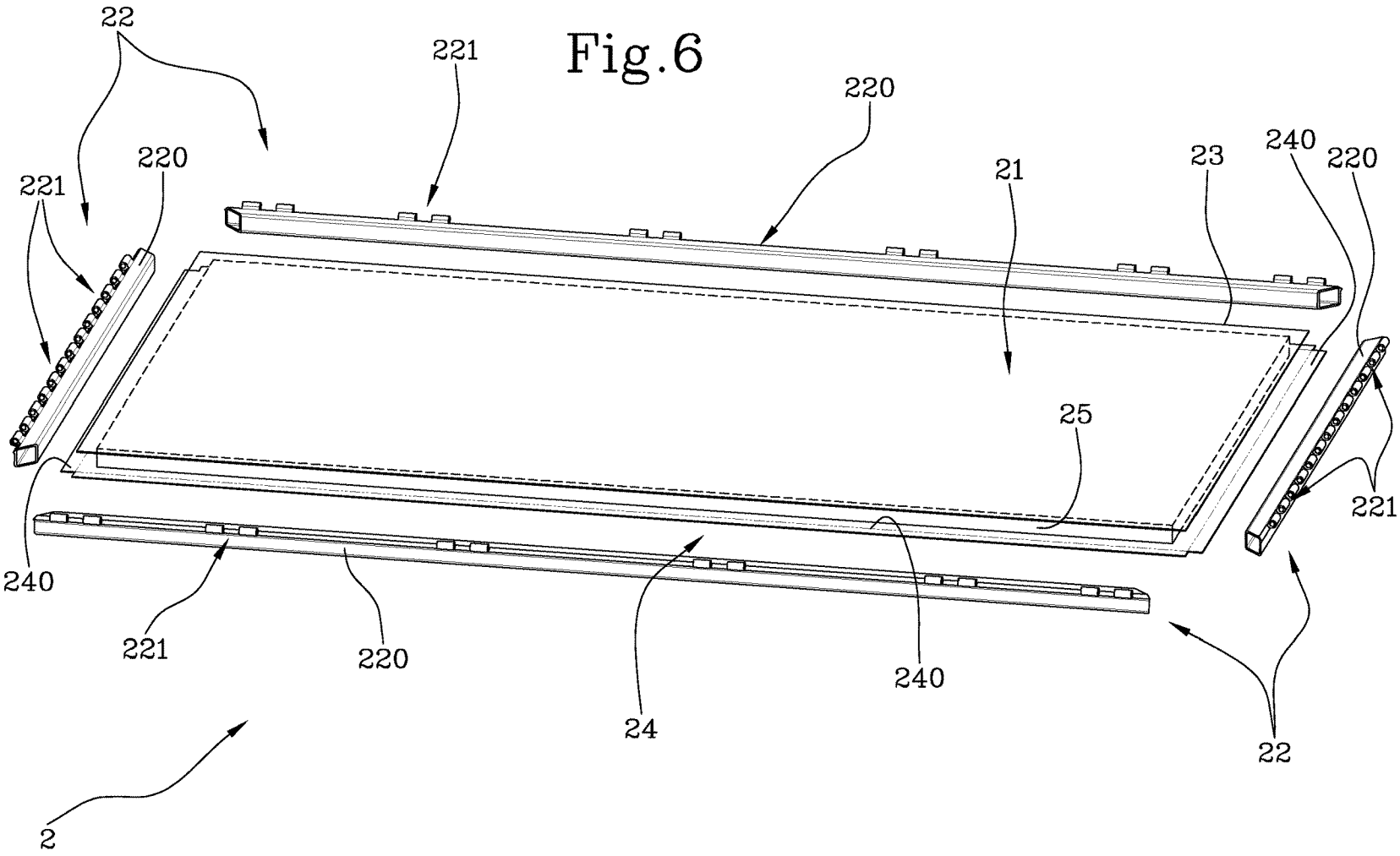
FIG. 6 is an exploded view of the plane of FIG. 5.

As can be seen in FIGS. 5 and 6, the bottom plane 2 of the invention may comprise an internal panel 21 and a frame 22 coupled to the panel 21 and provided with first means 221; the coupling mode will be discussed in a later section, where the structure of the plane 2 and the materials the latter is made of, are being disclosed.

In practice, this frame 22 is arranged substantially at the perimeter of the internal panel 21.

The aforementioned frame 22 can be formed by a plurality of profiles 220, for example one on each side of the panel 21, on each of which there are obtained articulation eyelets 221 of the first means (in the manner of "hinges"), preferably via machining (see in detail FIGS. 5 and 6).

As can be appreciated from the figures, the frame 22 bears the eyelets 221 of the first means at a top portion thereof, which means that the hinges are protruding upwards.

In detail, each section 220 of the frame 22 may be provided with more eyelets 221 distributed along its length.

The solid sidewalls 4, arranged at the ends of the loading platform 1, comprise the same components of the bottom plane 2 but are provided with a frame 22 that is devoid of one or more of the profiles 220 at the sides or edges thereof.

In order to become hinged to the bottom plane 2, in the embodiment shown in the figures, the solid sidewalls 4 are provided with only one profile 220.

The above mentioned truss sidewalls 3 preferably consist of a plurality of profiles 33, which are joined to one another in addition to being joined to the bottom plane 2, thereby defining said truss configuration.

The truss sidewalls 3 preferably comprise third interlocking and/or hinge means 34, 35 in order that the profiles 33 can be removably secured to one another thereby defining a mountable and demountable sidewall 3.

The configuration of the truss sidewalls 3 is such as to permit a modularity of the sidewalls 3 due to which modular sidewalls 3 are obtained, which are adaptable for example to the length of the bottom plane 2.

In detail, the truss sidewalls 3 may include lower profiles 33', one on each side of the plane 2, which profiles 33' are provided with the above-mentioned first means 31 (see FIG. 3).

In addition, these lower profiles 33' may be obtained via a processing not dissimilar to that applied to the profiles 220 of the frame 22 and may include several eyelets 31 distributed on the respective length and arranged to be coupled with those of the profiles 220 of the frame 22, with suitable pins or rods (not illustrated), being inserted therein.

The same solution, i.e. use of articulation eyelets 32, is preferably also applied in order to join a sidewall 3, to the other one 4, e.g. a truss sidewall 3 to a solid sidewall 4 as visible in FIGS. 1, 2, 7 and 8.

In this case, the truss sidewalls 3 are provided with lateral profiles 33" in turn provided with eyelets 32, which profiles 33" are structurally not dissimilar from the lower ones, although preferably shorter (see FIGS. 3 and 4).

As shown in FIGS. 3 and 4, said third means preferably comprise a plurality of angular elements 34, each adapted to connect respective ends of two profiles 33 that are arranged transversally in the corresponding side 3, thus defining the perimeter of the same.

In this case, each angular element 34 comprises two connecting members 341, 342, adapted to be inserted into respective profiles 33 in an interlocking manner at the ends thereof.

Such connecting members 341, 342 may be constituted by basically prismatic protrusions being respectively angled, preferably at 90°. In the preferred embodiment of the invention, the third means comprises a plurality of central elements 35, each adapted to be removably secured to a first profile 33 at a point of the length of the latter.

Each central element 35 includes a connecting member 351 adapted to be inserted in an interlocking manner, into the end of a second profile 33 that is disposed transverse to the first profile 33, internally of the respective sidewall 3.

In other words, particularly the profiles 33''' (depicted in FIG. 4), arranged internally of the sidewall, are connected together or to external profiles (i.e. the perimeter profile) by way of these substantially T-shaped central elements.

The central elements 35 may have a flat base 352 that can be fixed in a removable manner on a side of an outer profile 33 (or 33" in the case of lateral profiles), and a preferably prismatic protrusion 351 that slips into the horizontal profile 33'''.

In practice, the loading platform 1 of the invention is completely mountable and demountable and is largely modular, in the sense that the same components may be used for realizing differently sized loading platforms 1.

It should be appreciated that all the profiles 33, 220 previously described may be equal to each other at less than the length and with variable number and positions of the first hinge means 31, 32, 221.

Thus, the proposed separable and reassemblable loading platform 1 can be realized with the following four basic standard parts: the structure of the central panel 21 of the bottom plane 2 (used also for the solid sidewall 4), the "single" profile 220, 33, the angular element 34 and the central element 35.

With extremely contained costs, a loading platform 1 may be obtained that can be taken apart and put into a transport container where it occupies a very little space, and then be reassembled with ease once delivered at the destination.

According to a very important aspect of the invention, at least the bottom plane 2 and the sidewalls 3, 4 are made of aluminum and/or an aluminum containing product and a material at most as heavy as the aluminum (and preferably lighter).

In other terms, the truss sidewalls 3 may include aluminum profiles 33, joined together by aluminum elements 34, 35 included in the third means defined above.

For what concerns the bottom plane 2, the same is preferably formed by a sandwich panel 21, which comprises two aluminum outer plates 23, 24 (or "skins") between which a layer 25 (or "core") is interposed that is made of an alveolar polymer for example polypropylene, PVC, polycarbonate, etc. (see FIGS. 5 and 6).

By way of a per se known process, but not in combination with the other characteristics of the invention, a panel 21 is obtained which is formed by two parallel aluminum skins 23, 24 inextricably fixed by a polymeric core 25, thereby defining an almost monolithic artefact for practical purposes, and extremely lightweight.

In practice, the panel 21 thus formed allows high performance in terms of structural strength while being much lighter than prior art panels. According to an alternative embodiment, not depicted, the said sandwich aluminum panel provided with skins 23, 24 comprises, in the place of the alveolar polymeric core, an internal structure defined by a plurality of aluminum tubular components.

Even in this case, it is present the above frame 22.

Note that, regardless of the choice of the material and core structure, the panel 21 may optionally comprise a non-slip surface provided on the upper skin 23.

According to a preferred constructive aspect, the frame 22 mentioned above is housed within a perimeter cavity to the panel 21 defined by one of the aluminum plates 23, 24.

In practice, the central panel 21 can be preliminarily made with a bottom skin 24 which includes extensions 240, or wings, at the sides thereof; in this way, after fitting the profiles 220 of the frame 22 at the perimeter, the wings 240 are folded upwards, thus encompassing the frame 22 within the bottom plane 2 (see FIG. 6).

Being extremely lightweight, the loading platform 1 realized in the manner explained above, allows for a greater "working radius" during lifting by part of the telescopic arm and allows a much smoother and economic delivery once disassembled and loaded in the container.

An alternative embodiment is however not to be excluded, based on which the panel core is made of (alveolar) aluminum or any other type of non-polymeric material.

Furthermore, according to a non-preferential and non-illustrated version of the invention, there is provided use of a plurality of profiles adapted to fit together sequentially two by two along an ideal plane, thereby defining the bottom plane of the loading platform.

Figure 7:
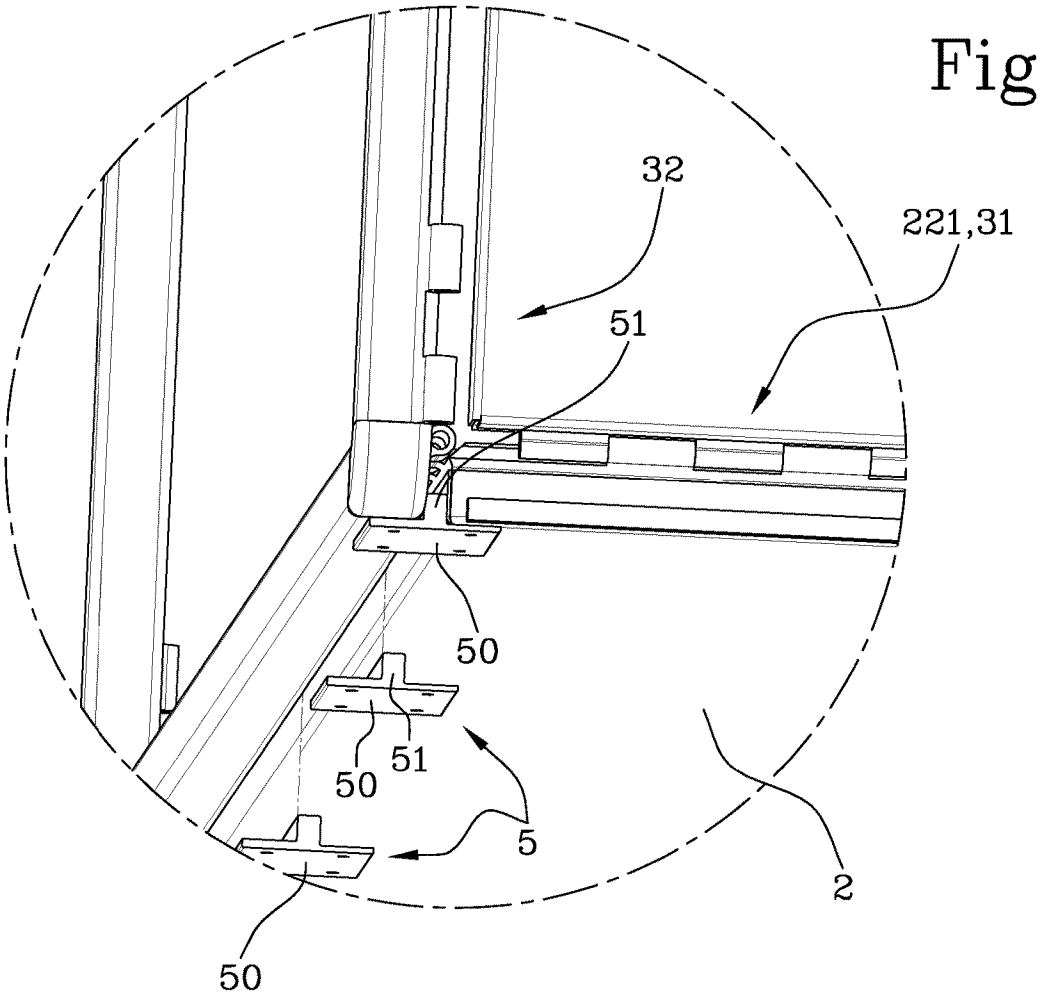
FIG. 7 shows a bottom edge of the loading platform.

According to an optional but advantageous aspect of the invention shown in FIG. 7, the loading platform 1 can be provided with stabilizer elements 5 provided with a bracket 51 insertable between the bottom plane 2 and the sidewalls 33, 34, in a position substantially coplanar to the hinge 221, 31 joining them.

In detail, these stabilizers 5 are particularly devised for being secured in a removable manner below the loading platform 1, at the junction area between the sidewalls 3, 4 and the bottom plane 2, where there is defined a rectilinear recess running along the length of the corresponding side of the loading platform 1.

The aforementioned bracket 51 is shaped to fit to size in such rectilinear recess, thus substantially eliminating the clearance between the sidewalls 3, 4 and the bottom plane 2 due to the fact that they are joined by means of hinges.

In detail, each stabilizer 5 can be made of an aluminum or plastic material, be T-shaped and comprise a base plate 50 which is removably fixable to both the respective sidewall 3, 4 and the bottom plane 2, from which base 50 the aforementioned bracket is standing 51.

For each sidewall 3, 4, several stabilizers can be applied 5, which ensure annulment of said clearance.

Figure 8:
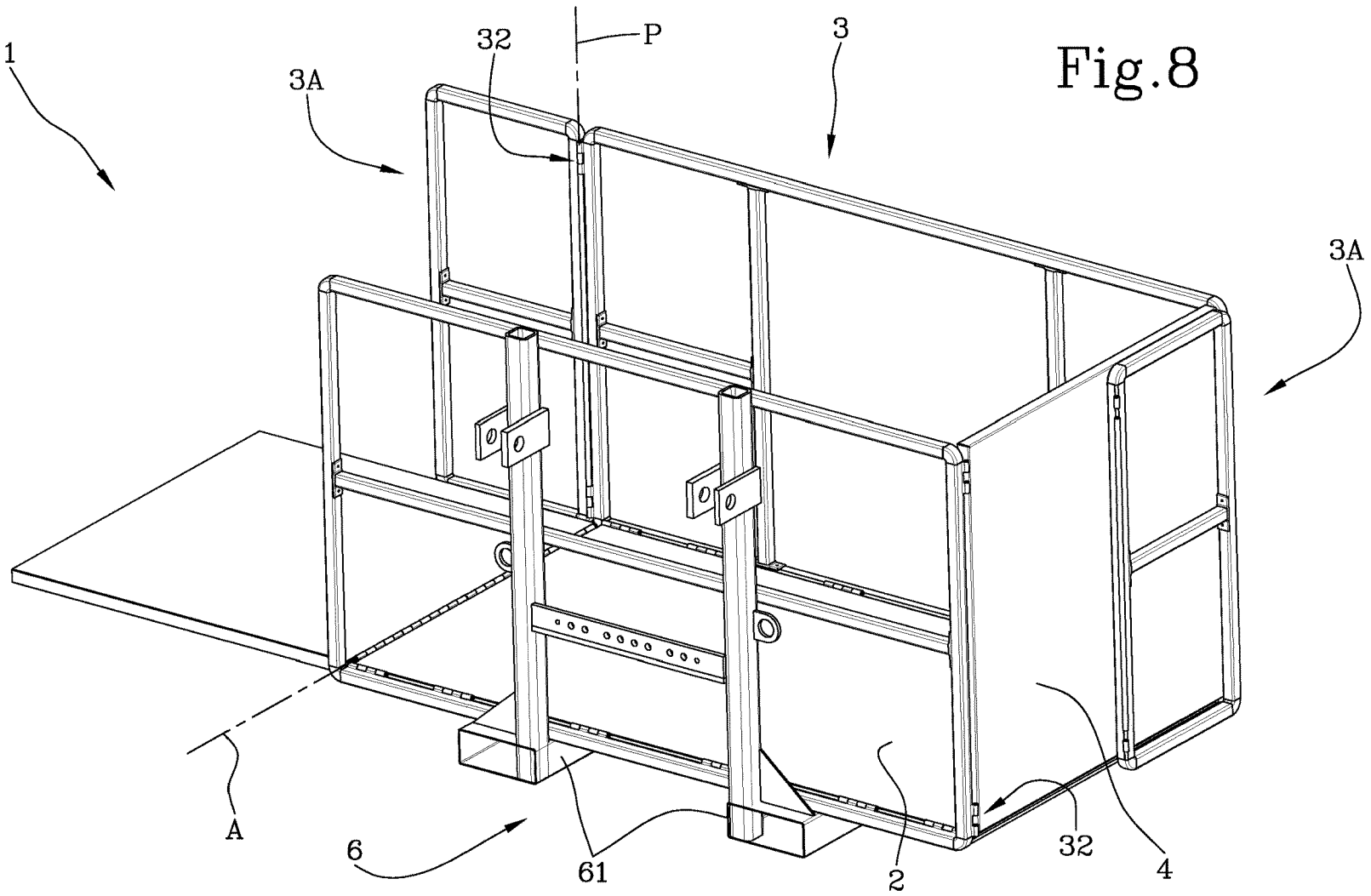
FIG. 8 is a rear isometric view of a loading structure comprising the inventive platform.

As depicted in FIG. 8, the invention may provide a coupling device 6 that can be secured in a removable manner to the loading platform 1, which coupling device 6 is adapted to be connected directly to the arm of a telescopic handler, thereby defining a complete loading structure 1.

Between the coupling device 6 and the lift arm there is interposed an equipment, not shown, which in the prior art is termed "fixed attachment" or "rotation"; unlike the coupling device 6, such equipment, permits to the loading platform 1 to be oriented according to the needs arising from the operations to be carried out.

Such coupling device 6 is preferably positioned at a sidewall 3 of the loading platform 1, in a central position with respect to the same and is adapted to support the loading platform 1 and load thereof by means of a pair of support sections 61 fixed under the bottom of the loading platform 1.

The coupling device 6 in question may be constituted by a truss structure of profiles made up of iron, aluminum or any other material suitable for the purpose.

In the attached figures, the loading platform 1 is shown with an open end not only to emphasize its modularity, which has been discussed previously, but also to illustrate the extensibility thereof.

In fact, preferably, the two end sidewalls 4 of the invention are solid sidewalls, and once released from the lateral truss sidewalls 3, they can rotate about a horizontal axis A and coplanar to the bottom plane 2, between a retracted position, wherein the sidewalls are vertically positioned, and an extended position, wherein the sidewalls are aligned to the bottom plane 2 thereby extending the bottom plane 2 of the loading platform 1.

Preferably, the loading platform 1 further includes one or more truss sidewall portions 3A realized constructively as the truss sidewalls 3 described above.

Such sidewall portions 3A are hinged to respective sidewalls 3 at corresponding profiles 33 arranged at opposite longitudinal ends of the loading platform 1; these portions 3A are functionally associated with the solid sidewalls 4 and the lateral sidewalls 3 in a manner explained below. Once tilted the solid sidewalls 4 in the extended position thereof, the sidewall portions 3A become rotatable about an axis P perpendicular to the bottom plane 2 and passing through the hinge by which the sidewall portions 3A are connected to the lateral sidewalls 3 between a retracted position, wherein the portions 3A are proximate to the respective solid sidewalls 4, and an extended position, wherein the portions 3A are arranged aligned to the solid sidewalls 4, thereby defining extensions thereof.

Hence, the inventive loading platform 1 is capable of extending and retracting at least in the longitudinal direction.

By the disclosure of the invention set forth above, it is clear how the loading platform 1 herein proposed is able to overcome all the drawbacks exhibited by the loading platforms of the known type consisting of steel components welded to one another as already mentioned.

In fact, although on the one hand the cost of production of known loading platforms is not particularly high, on the other hand their foreign shipment is extremely costly for the reasons already explained above.

The invention provides instead a completely dismantlable and re-assemblable loading platform 1 that can be placed on a transport container where it occupies very little space, for then being re-assembled with ease once delivered to the destination.

Moreover, production costs of the inventive loading platform 1 are extremely low in that, as explained above, the dismantlable and re-assemblable loading platform 1 proposed herein, can be realized using a few standard basic pieces i.e.: the structure of the central panel 21 of the bottom plane 2, which is also used for the solid sidewall 4, the profile 220, 33, the angular element 34 and the central element 35.

Finally, because the loading platform 1 provided herein is realized based on the special aluminum configuration illustrated above, it exhibits great structural strength while being much lighter than the known loading platforms, thus allowing to reach in complete safety a working radius major than that of the lifting arm whereon the same is mounted.

The invention claimed is:

1. A loading platform (1) for telescopic handlers or other similar machines, comprising at least a bottom plane (2) provided for supporting operators and/or equipment and associated with sidewalls (3, 4), wherein said bottom plane (2) and said sidewalls (3,4) include respective first interlocking and/or hinge means (31, 221) such that the sidewalls (3, 4) can be removably secured to the bottom plane (2), thereby defining a mountable and demountable platform (1);

wherein said sidewalls (3, 4) comprise respective second interlocking and/or hinge means (32) for fixing removably the different sidewalls one to another;

wherein the platform comprises truss sidewalls (3) each comprising a plurality of profiles (33) and at least third interlocking and/or hinge means (34, 35) in order to secure the profiles one to another in a removable manner, thus defining mountable and demountable sidewalls (3); and wherein said first and second means (31, 221, 32) are of the hinge type and said third means (34, 35) are of the interlocking type.

2. A platform (1) according to claim 1, wherein the bottom plane (2) comprises an internal panel (21) and a frame (22) coupled to the panel (21), wherein the frame (22) is provided with said first means (221).

3. A platform (1) according to claim 1, in which at least the bottom plane (2) and the sidewalls (3, 4) are made of aluminum and/or of a product consisting of aluminum and of a material which is at most as heavy as aluminum.

4. A platform (1) according to claim 3, wherein at least the bottom plane (2) includes a layer of alveolar aluminum.

5. A platform (1) according to claim 3, wherein at least the bottom plane (2) comprises a layer (25) made of alveolar polymer.

6. A platform (1) according to claim 3, wherein at least the bottom plane (2) includes a sandwich panel (21) which comprises two aluminum plates (23, 24) between which a layer (25) is interposed.

7. A platform (1) according to claim 6, wherein the bottom plane (2) comprises an internal panel (21) and a frame (22) coupled to the panel (21), wherein the frame (22) is provided with said first means (221), wherein said frame (22) is housed within a perimeter cavity defined by one of said aluminum plates (24) of the panel (21).

8. A platform (1) according to claim 3, comprising a plurality of profiles adapted to interlock together two by two, thereby forming said bottom plane.

9. A platform (1) according to claim 2, comprising at least one solid sidewall (4) obtained as the bottom plane (2).

10. A platform (1) according to claim 1, wherein said third means comprises a plurality of angular elements (34), each adapted to connect respective ends of two profiles (33), which are arranged transversally within the respective sidewall (3), each angular element comprising at least two connecting members (341, 342) adapted to be inserted into respective profiles in an interlocking manner.

11. A platform (1) according to claim 1, wherein said third means comprises a plurality of central elements (35), each of which is suitable for being secured in a removable manner to a first profile (33) and comprising at least one connecting member (351) adapted to be inserted, in an interlocking manner, into the end of a second profile (33), which is arranged transverse to the first profile.

12. A loading structure comprising a platform (1) according to claim 1 and a coupling device (6) being secured in a removable manner to the platform (1), which coupling device (6) is suitable for being connected directly to the arm of a telescopic handler or similar machines.

* * * * *